US010059353B2

(12) United States Patent
Draheim

(10) Patent No.: US 10,059,353 B2
(45) Date of Patent: Aug. 28, 2018

(54) SPEED CONTROL SYSTEM FOR A RAILCAR MOVER

(71) Applicant: Trackmobile LLC, LaGrange, GA (US)

(72) Inventor: Allan Draheim, Lagrange, GA (US)

(73) Assignee: Trackmobile LLC, LaGrange, GA (US)

( * ) Notice: Subject to any disclaimer, the term of this patent is extended or adjusted under 35 U.S.C. 154(b) by 51 days.

(21) Appl. No.: 15/403,287

(22) Filed: Jan. 11, 2017

(65) Prior Publication Data

US 2018/0194376 A1 Jul. 12, 2018

(51) Int. Cl.

| | |
|---|---|
| ***G05D 1/00*** | (2006.01) |
| ***B61L 3/00*** | (2006.01) |
| ***B61L 15/00*** | (2006.01) |

(52) U.S. Cl.

CPC ..... *B61L 3/006* (2013.01); *B61L 3/008* (2013.01); *B61L 15/009* (2013.01)

(58) Field of Classification Search

CPC ..... B61L 3/006; B61L 3/008; B61L 15/009; G06F 7/00

USPC ..... 701/1, 2, 20, 19, 213, 93, 96; 246/182, 246/186, 189, 181

See application file for complete search history.

(56) References Cited

U.S. PATENT DOCUMENTS

| | | | | |
|---|---|---|---|---|
| 8,509,971 | B1 * | 8/2013 | Isailovski | B61L 15/009 246/182 A |
| 2004/0245410 | A1 * | 12/2004 | Kisak | B61L 15/0027 246/3 |
| 2005/0010338 | A1 * | 1/2005 | Kraeling | B61L 3/121 701/19 |
| 2008/0077285 | A1 * | 3/2008 | Kumar | B61L 3/006 701/19 |
| 2014/0229040 | A1 * | 8/2014 | Weber | B61L 23/00 701/19 |
| 2015/0166086 | A1 * | 6/2015 | Branka | B61L 15/0072 701/19 |
| 2017/0096154 | A1 * | 4/2017 | Hurst | B61L 25/025 |
| 2017/0129515 | A1 * | 5/2017 | Weber | B61L 27/04 |

* cited by examiner

*Primary Examiner* — Shardul D Patel
(74) *Attorney, Agent, or Firm* — Banner & Witcoff, Ltd.

(57) ABSTRACT

A speed control system for a railcar mover where the speed control system prevents the railcar mover from exceeding a predetermined maximum vehicle speed. The speed control system determines a target engine speed that overrides a user's throttle control input to keep the railcar mover from exceeding the predetermined maximum vehicle speed. The speed control system also determines a target throttle control position and disables the throttle control from the user until the user moves the throttle control to a position at or less than the target throttle control position.

20 Claims, 4 Drawing Sheets

SPEED CONTROL SYSTEM FOR A RAILCAR MOVER

TECHNICAL FIELD

The disclosure relates generally to a speed control system for railcar movers.

BACKGROUND

Railcar movers provide a more efficient way to move railcars around within a rail yard than using a locomotive for such tasks. The railcar movers while efficient at moving railcars may sometimes move the railcars around the rail yard at a speed that may be unsafe depending upon the conditions within the rail yard. A means to control the maximum speed of the railcar mover, while still allowing the engine of the railcar mover to reach a full power mode for accelerating when travelling below the maximum speed would enhance safety conditions within the rail yard.

BRIEF SUMMARY

Aspects of this disclosure relate to a system for controlling a maximum vehicle speed of a railcar mover comprising, where the railcar mover comprises an engine, a display system positioned within a cab of the railcar mover, a processor connected to an engine control module where the engine control module controls a speed of the engine and receives information from a plurality of sensors within the engine, a throttle control engaged by a user, a throttle control module connected to the throttle control and the processor, where the throttle control module is configured to receive input from the throttle control and send instructions to the throttle control. The system may further comprise a non-transitory computer readable medium storing computer readable instructions that, when executed by the processor, causes the processor to at least: acquire a predetermined value for maximum vehicle speed from a graphical user interface configured on the display system; calculate a target engine speed; communicate the target engine speed to the engine control module to prevent the engine from exceeding the target engine speed; calculate a target throttle control position; communicate the target throttle control position to the throttle control module; acquire an actual throttle control position; compare the target throttle control position to the actual throttle control position; and upon determining if the actual throttle position is less than or equal to the target throttle position, communicate to the throttle control module to release the throttle control to the user.

Additional aspects of this disclosure relate to a system for controlling a maximum vehicle speed of a railcar mover where the maximum vehicle speed is controlled to within 0.1 miles per hour and prevent the vehicle speed of the railcar mover from exceeding the predetermined value for maximum vehicle speed by more than 0.1 miles per hour. The system may recalculate the target engine speed every 50 milliseconds. Also, the target throttle position may act to give the user an intuitive sense of a required throttle position. In addition, the engine speed may be controlled when the railcar mover is in either a rail mode or a road mode. The target engine speed may be calculated using a plurality of parameters including the predetermined value for maximum vehicle speed, a transmission gear selected, a torque converter speed ratio, a vehicle rate of speed change, a vehicle operating mode, and a feature enabled state. The processor may calculate the vehicle rate of speed change every 250 milliseconds and may disregard the vehicle rate of speed change if the railcar mover is decreasing in speed.

Still other aspects of this disclosure relate to a system for controlling a maximum vehicle speed of a railcar mover where the railcar mover may comprise an engine, a display system positioned within a cab of the railcar mover, a processor connected to an engine control module, where the engine control module controls a speed of the engine and receives information from a plurality of sensors within the engine, a throttle control engaged by a user, a throttle control module connected to the throttle control and the processor, where the throttle control module is configured to receive input from the throttle control and send instructions to the throttle control. In addition the system may comprise a non-transitory computer readable medium storing computer readable instructions that, when executed by the processor, causes the processor to at least: acquire a predetermined value for maximum vehicle speed from a graphical user interface configured on the display system; calculate a target engine speed, wherein the target engine speed is calculated using a plurality of parameters including the predetermined value for maximum vehicle speed, a transmission gear selected, a torque converter speed ratio, a vehicle rate of speed change, a vehicle operating mode, and a feature enabled state; communicate the target engine speed to the engine control module to prevent the engine from exceeding the target engine speed; calculate a target throttle control position; communicate the target throttle control position to the throttle control module; acquire an actual throttle control position; compare the target throttle control position to the actual throttle control position; upon determining if the actual throttle control position is less than or equal to the target throttle control position, communicate to the throttle control module to release the throttle control to the user.

Yet other aspects of this disclosure relate to a system for controlling a vehicle speed of a railcar mover where the railcar mover may comprise an engine connected to an engine control module, where the engine control module controls a speed of the engine and receives information from a plurality of sensors within the engine, a display system positioned within a cab of the railcar mover, a processor connected to the engine control module, a throttle control engaged by a user, a throttle control module connected to the throttle control and the processor, where the throttle control module is configured to receive input from the throttle control and send instructions to the throttle control. The speed control system may further comprise a non-transitory computer readable medium storing computer readable instructions that, when executed by the processor, causes the processor to at least: acquire a predetermined value for maximum vehicle speed; calculate a target engine speed, wherein the target engine speed is calculated using a plurality of parameters including the predetermined value for maximum vehicle speed, a transmission gear selected, a torque converter speed ratio, a vehicle rate of speed change, a vehicle operating mode, and a feature enabled state; communicate the target engine speed to the engine control module to prevent the engine from exceeding the target engine speed; calculate a target throttle control position, wherein the target throttle control position is calculated using at least the target engine speed; communicate the target throttle control position to the throttle control module; acquire an actual throttle control position; compare the target throttle position to the actual throttle position; upon determining if the actual throttle position is less than or equal to the target throttle position, communicate to the throttle control module to release the throttle control to the user.

BRIEF DESCRIPTION OF THE DRAWINGS

The present invention is illustrated by way of example and not limited in the accompanying figures in which like reference numerals indicate similar elements and in which.

Further, it is to be understood that the drawings may represent the scale of different components of one single embodiment; however, the disclosed embodiments are not limited to that particular scale.

DETAILED DESCRIPTION

In the following description of various example structures according to the disclosure, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present disclosure. Also, while the terms "top," "bottom," "front," "back," "side," "rear," and the like may be used in this disclosure to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention.

Figure 1:
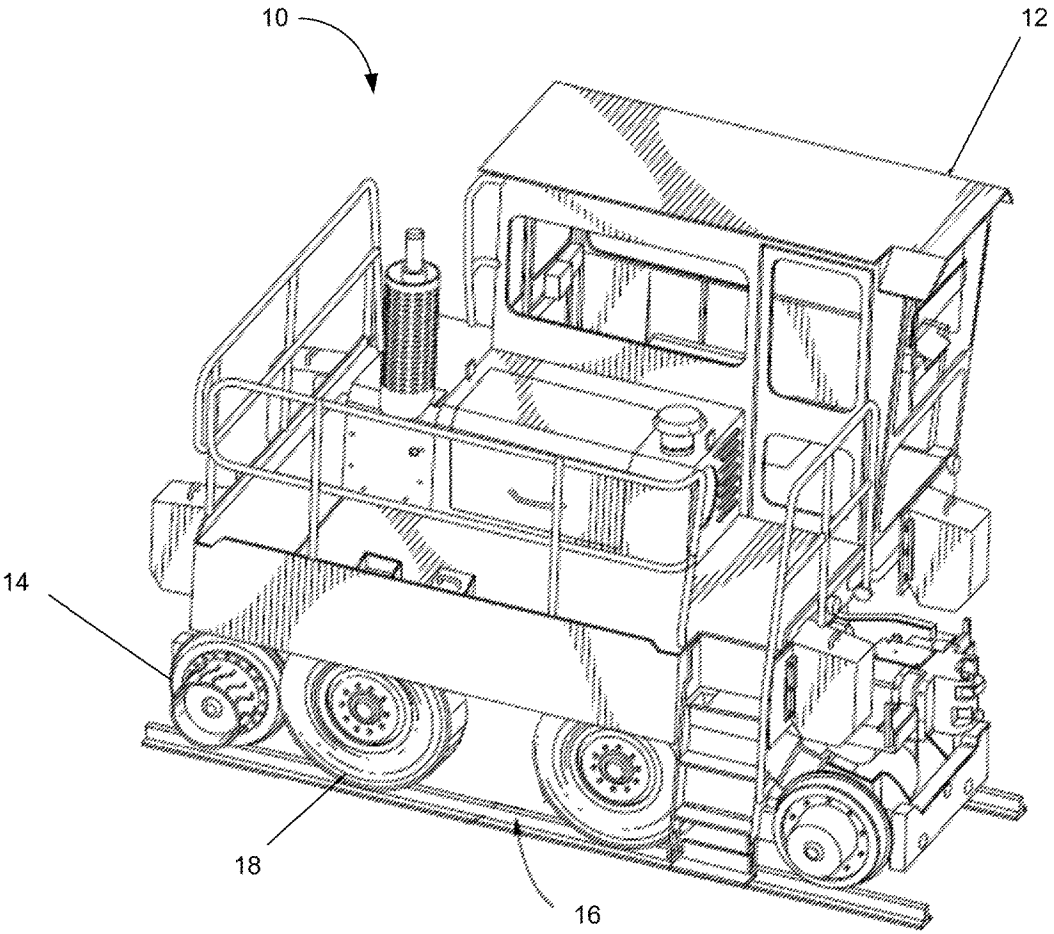
FIG. 1 depicts an isometric view of an example railcar mover according to one or more aspects described herein.
Figure 2:
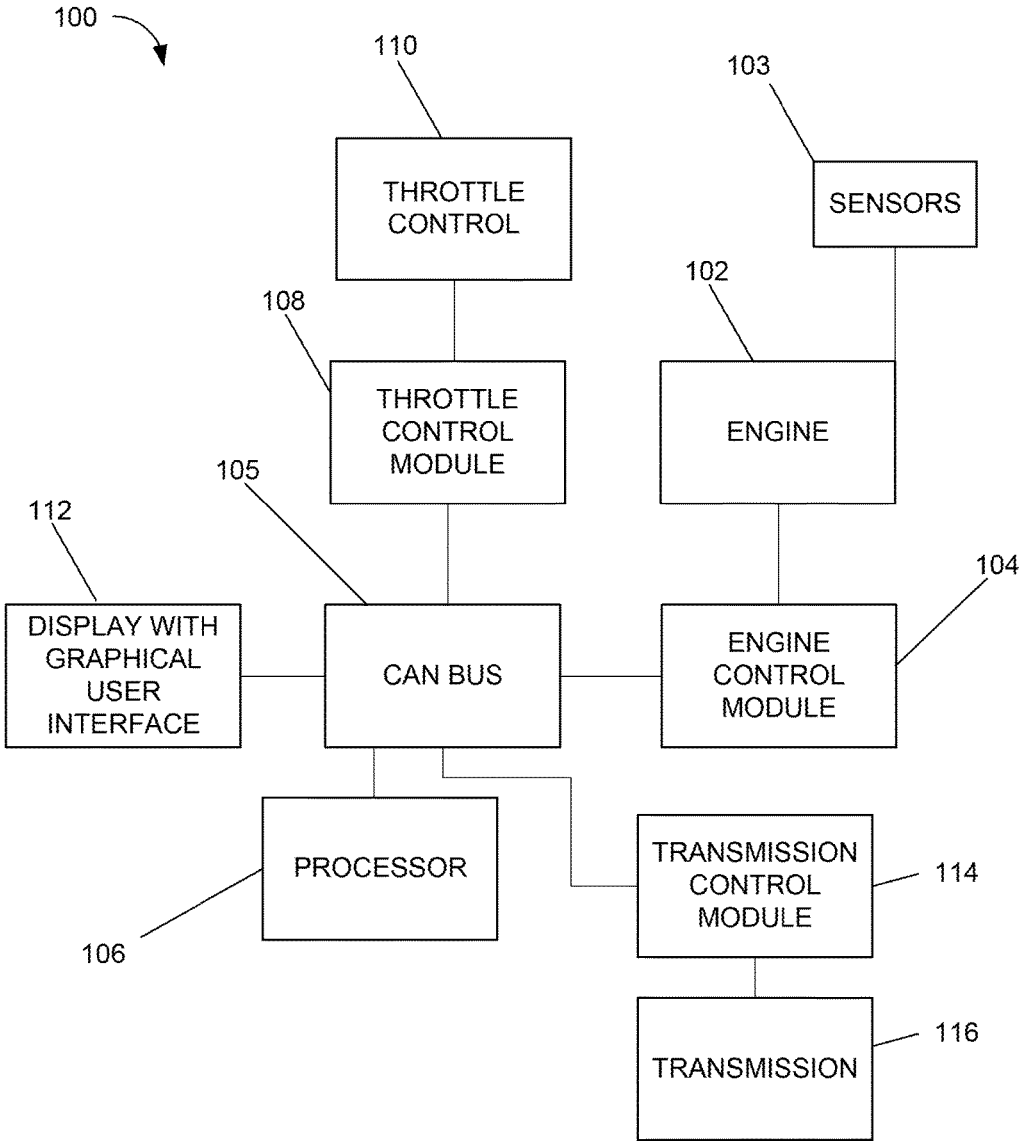
FIG. 2 depicts a schematic of a system for controlling the speed of a railcar mover according to one or more aspects described herein.

Generally, this disclosure describes a system for controlling the vehicle speed 100 of a railcar mover 10 shown in FIGS. 1 and 2. As illustrated in FIG. 1, the railcar mover 10 may have a cab 12 along with a plurality of rail wheels 14 for operating on the rails 16 and a plurality of road wheels 18 for operating off the rails 16. The speed control system 100 may prevent a railcar mover 10 from exceeding a predetermined value for a maximum vehicle speed or alternatively may prevent a railcar mover 10 from exceeding a predetermined value for a maximum vehicle speed by more than 0.1 miles per hour.

FIG. 2 shows a schematic of the speed control system 100 where an engine 102 of the railcar mover 10 is connected to an engine control module 104 which is connected to the Controller Area Network (CAN bus) 105 of the railcar mover 10. The speed control system 100 may limit the vehicle speed by controlling the engine speed of the railcar mover 10 while allowing the full power of the engine to be utilized until the predetermined maximum vehicle speed is reached. Once the predetermined maximum vehicle speed is reached, the speed control system 100 may continue to monitor and modulate the engine power as required to maintain the appropriate speed. FIG. 2 further shows a processor 106, and a display system 112 that may be positioned within the cab 12 of the railcar mover 10 also connected to the CAN bus 105. A throttle control module 108 and throttle control 110 may be connected to the CAN bus 105. In addition, the transmission control module 114 and the transmission 116 may be connected to the CAN bus 105. By connecting through the CAN bus 105 of the vehicle the engine control module 104, the processor 106, the throttle control module 108, the display system 112, and the transmission control module 114 may communicate effectively with each other. In some embodiments, the display system 112 may include the processor 106.

For example, as the railcar mover 10 accelerates from a stationary position to the maximum vehicle speed, the user may operate the throttle control 110 normally without intervention from the speed control system 100. The engine 102 may have full engine power available to accelerate the railcar mover 10. The speed control system 100 may monitor the vehicle speed continuously until an intervention is required due to the vehicle approaching the predetermined maximum vehicle speed. When an intervention is required, the maximum vehicle speed may be controlled within 0.1 miles per hour or within a range of 0.05 miles per hour and 0.25 miles per hour. For example, if the vehicle crosses the predetermined maximum vehicle speed at a low rate of speed change, such as exceeding by 0.1 mph, the speed control system 100 may engage at the point of the vehicle speed reaches or is greater than the predetermined maximum vehicle speed. Alternatively, if the vehicle is approaching the predetermined maximum vehicle speed at a very high rate of speed change, the speed control system 100 may engage to override the manual input of the throttle control 110 and slow the rate of acceleration to prevent the railcar mover 10 from exceeding the predetermined maximum vehicle speed. As an example, the throttle control 110 may be fully deflected by the operator, but the speed control system 100 will keep the engine speed from exceeding the target engine speed.

The engine 102 may be the main power source for the railcar mover 10, such as a diesel engine and may be controlled by an engine control module 104. The engine control module 104 may control the speed of the engine 102 and also may receive information from a plurality of sensors 103 within the engine 102 to better optimize the engine performance. The engine control module 104 may also provide information such as engine speed to the processor 106. For example, the engine control module 104 may utilize an SAE J1939-71 defined TSC1 engine speed control for normal, non-speed limiting functions. The speed control system 100 may enhance this control method to provide a target engine speed that may be adjusted at a set time interval. For example, the processor 106 may calculate a target engine speed every 50 milliseconds, or alternatively the processor 106 may calculate a target engine speed every 250 milliseconds, or the processor 106 may calculate a target engine speed within a range of every 50 milliseconds to every 250 milliseconds.

The processor 106 may be a general-purpose processor, a digital signal processor (DSP), an application-specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, or any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. The one or more implementations described throughout this disclosure may utilize logical blocks, modules, and circuits that may be implemented or performed with a processor 106.

The processor 106 may be used to implement various aspects and features described herein. As such, the processor 106 may be configured to execute multiple calculations, in parallel or serial and may execute coordinate transformations, curve smoothing, noise filtering, outlier removal, amplification, and summation processes, and the like. The processor 106 may include a processing unit and system memory to store and execute software instructions.

The throttle control module 108 may be configured receive the input from throttle control 110 as well as send instructions to the throttle control 110. The throttle control 110 may comprise a joystick, pedal or other means of manual input from a user.

Figure 4:
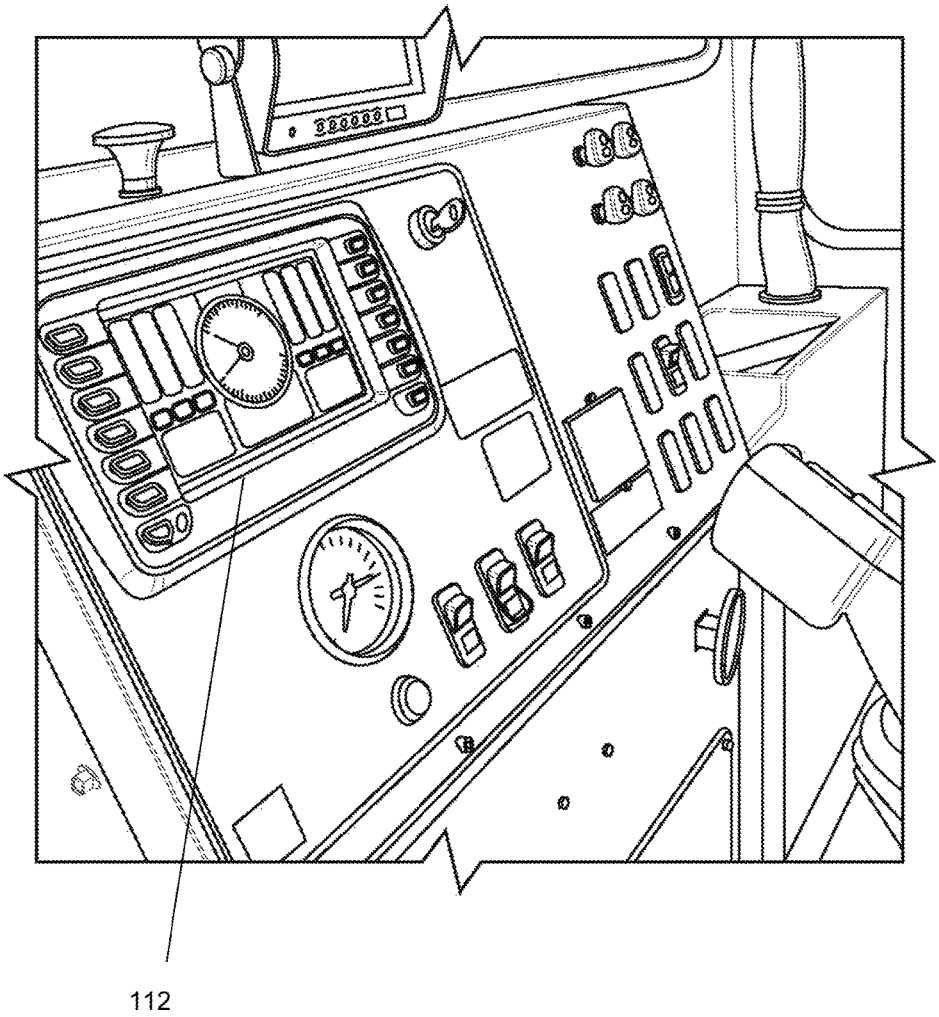
FIG. 4 depicts an illustrative view of a cab and display system positioned within the example railcar mover from FIG. 1 according to one or more aspects described herein.

The display system 112 may comprise a visual display system mounted within the cab 12 of the railcar mover 10. FIG. 4 illustrates an exemplary display system 112 mounted within the cab 12 of the railcar mover 10. The display system 112 may include a graphical user interface (GUI) to allow the user to easily navigate a menu system. For example, the user may be able to enable and disable the speed control system 100 using the graphical user interface. When the speed control system 100 is enabled, the user is able to enter or make adjustments to the predetermined value for maximum vehicle speed and save it to the speed control system 100. The speed control settings screen may only be accessible when the speed control system 100 is enabled. An exemplary display system 112 may be similar to an Ultra View 780 display produced by Class 1 Electronics or the Murphy Power View 780 display produced by Enovation Controls. Alternatively, the user may be able to adjust the speed control settings through an alternate interface such as a portable computer or handheld device where the processor 106 is connected to the CAN bus 105.

Figure 3:
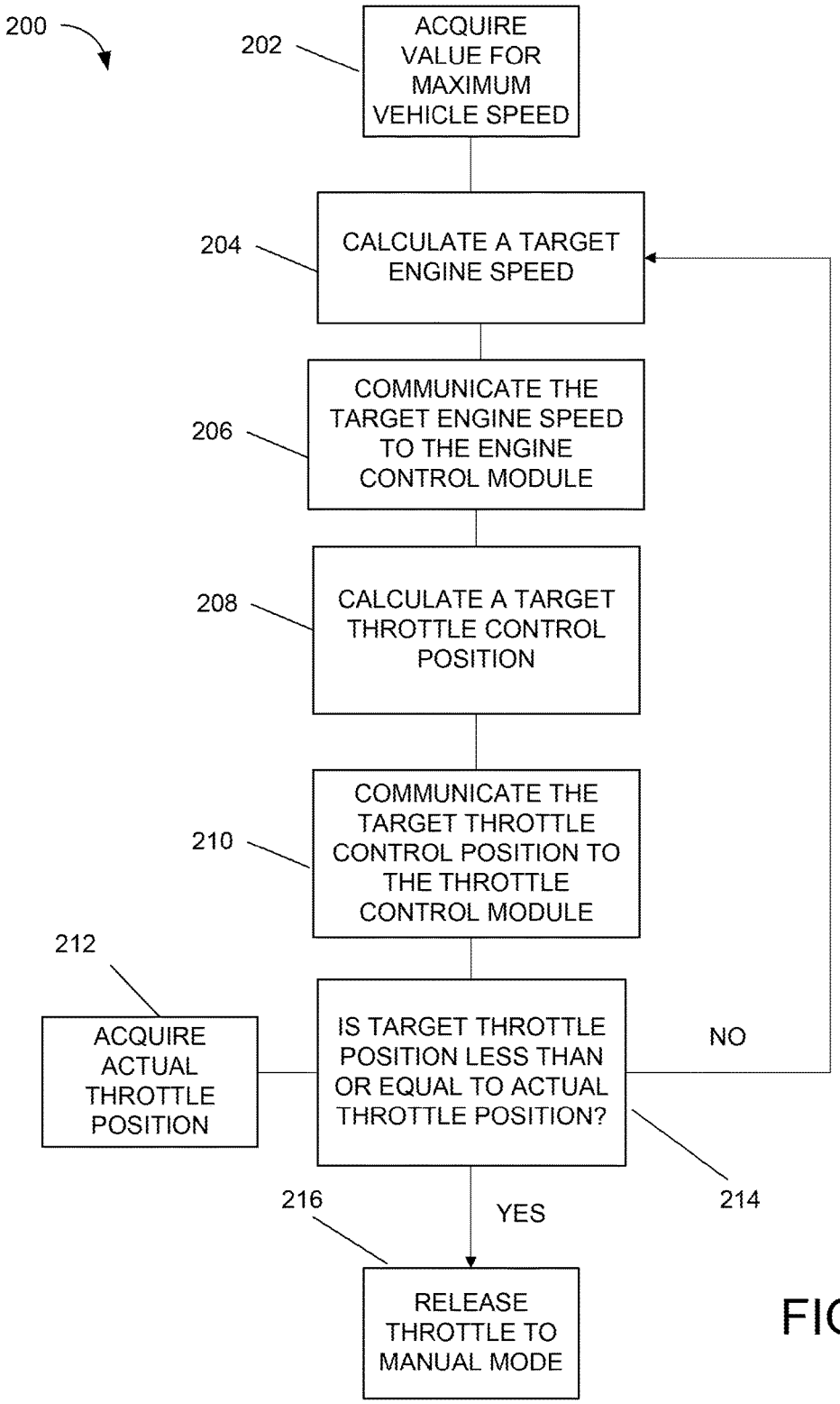
FIG. 3 depicts an illustrative flowchart diagram of the system for controlling the speed of a railcar mover according to one or more aspects described herein.

The speed control system 100 may further include a non-transitory computer readable medium storing computer readable instructions 200 that, when executed by the processor 106, causes the processor 106 to perform and execute at least a plurality of steps shown in the flowchart shown in FIG. 3. As shown in FIG. 3, the processor 106 may acquire a predetermined value for maximum vehicle speed 202; calculate a target engine speed 204; communicate the target engine speed to the engine control module to prevent the engine from exceeding the target engine speed 206; calculate a target throttle control position 208); communicate the target throttle control position to the throttle control module 210; acquire an actual throttle control position 212; compare the target throttle control position to the actual throttle control position 214; and upon determining if the actual throttle position is less than or equal to the target throttle position, communicate to the throttle control module to release the throttle control to the user 216.

In step 202, the processor 106 may acquire the predetermined value for the maximum vehicle speed. Next, the processor 106 may calculate a target engine speed 204. The target engine speed may be calculated using a plurality of parameters including the predetermined value for the maximum vehicle speed, a transmission gear selected, a torque converter speed ratio, a vehicle rate of speed change, a vehicle operating mode, and a feature enabled state.

The processor 106 may perform dynamic calculations to estimate the target engine speed in revolutions per minute (RPM) required to maintain the predetermined maximum vehicle speed once that maximum speed has been reached. This engine speed may be based upon the transmission gear ratio and drivetrain ratios of the railcar mover 10. The target engine speed calculations may have a further compensatory element that is dependent upon the torque converter speed ratio which may be calculated using a plurality of parameters including the engine speed, the vehicle speed, and the vehicle drive ratio. This ratio may determine the amount of slip occurring in the torque converter and may change constantly throughout vehicle operation. The transmission 116 may not have an input speed sensor, which may require the transmission input speed to be calculated to determine the torque converter speed ratio. The transmission input speed may be calculated using the vehicle speed and the final drive ratio.

The processor 106 may further use the vehicle rate of speed change as a factor within the calculation of target engine speed to assist in limiting "overshoot" which leads to excessive engine "RPM hunting" or engine speed fluctuation. In terms of trying to control vehicle speed, "RPM hunting" occurs when the engine speed tends to fluctuate or oscillate while trying approach or maintain a set vehicle speed. For example, as a vehicle approaches a set maximum speed, the engine may be running at a higher speed, then as the vehicle reaches or exceeds the set vehicle speed, the engine speed may lower significantly to slow down or maintain the vehicle's speed. However, as the vehicle then slows due to the reduced engine speed, the engine speed may then significantly increase to bring the vehicle back to the set maximum speed. This cycle may then repeat itself. By using the vehicle rate of speed change within the target engine speed calculation, the engine speed may experience fluctuations in engine speed less than 100 RPM while having a consistent load or less than 75 RPM, or even less than 50 RPM, as the vehicle approaches and maintains the predetermined value for maximum speed. One of the reasons this happens in this situation is because of the extreme mass of the railcar mover 10 and the inability to be able to control this maximum speed with the railcar mover 10 using conventional engine controls.

The vehicle rate of speed change is calculated at 250 millisecond intervals, or at 150 millisecond intervals, or at 50 millisecond intervals. The processor 106 may acquire the vehicle speed and compare it to the previous vehicle speed to determine the vehicle rate of speed change. The vehicle rate of speed change may be expressed as miles per hour change per 250 millisecond interval. The processor 106 may only consider the rate of speed change if the value is positive, meaning the vehicle is increasing in speed. If the rate of speed change has a negative value, meaning the vehicle is decelerating, or decreasing in speed, the processor 106 may disregard the rate of speed change value. The vehicle rate of speed change may be heavily influenced individually or in combination by the weight of the railcar mover 10, the connected load, or the inclination of the rail.

Additionally, the processor 106 may control the target engine speed if the railcar mover 10 is operating in "Rail Mode" for moving along the railroad rails or in "Road Mode" when not moving along the railroad rails. The processor 106 may use a factor within the target engine speed calculation to compensate for the final drive ratios and wheel diameter relationship differences between railcar mover 10 when operating in "Rail Mode" compared to "Road Mode." The target engine speed calculation may default to "Rail Mode" so the compensation factor may only be used in "Road Mode."

In step 206, the processor 106 may communicate the maximum engine speed to the engine control module 104 to prevent the engine speed from exceeding target engine speed. Next, the processor 106 may calculate a target throttle control position that correlates to the target engine speed 208. The user input or throttle control position may generate an analog signal that is converted to a digital signal using an analog to digital converter. The digital signal may then be sent to the engine control module 104 via a standard message, such as a SAE J1939-71 TSC1 standard message. If the user input or throttle control position requests a higher engine speed than the predetermined maximum engine speed, the engine control module limits the engine speed to the predetermined maximum engine speed. This target throttle control position is then communicated to the throttle control module 108 by the processor 106 in step 210. The target throttle control position may act to give the user an intuitive sense of a required throttle position to prevent the railcar mover 10 from exceeding the predetermined value for the maximum vehicle speed as even if the throttle control 110 is fully deflected by the operator/user the engine speed will not increase.

The processor 106 may then acquire the actual throttle control position in step 212 and compare the target throttle control position to the actual throttle control position in step 214. If the actual throttle position is greater than the target throttle position, the throttle control 110 remains overridden by the processor 106 such that the throttle control 110 is controlled by the processor 106. However, if the actual throttle position is less than or equal to the target throttle position, the processor 106 releases the throttle control 110 back to a manual mode such that the user resumes control of the throttle control 110 in step 216.

Due to the intra-dependence of the components, the control system 100 may be overridden if the display system 112 or processor 106 is removed from the CAN bus. By removing either the display system 112 or processor 106 from the control system 100, the railcar mover 10 will return to a traditional operational mode, wherein the vehicle speed is unlimited. This return to a traditional operational mode is a safety feature to prevent the failure of the throttle and braking system in the case of a display system 112 or a processor 106 failure.

Further, the computer-readable media may store software code/instructions configured to control one or more of a general-purpose, or a specialized computer. Said software may be utilized to facilitate interface between a human user and a computing device, and wherein said software may include device drivers, operating systems, and applications. As such, the computer-readable media may store software code/instructions configured to perform one or more implementations described herein.

Those of ordinary skill in the art will understand that the various illustrative logical blocks, modules, circuits, techniques, or method steps of those implementations described herein may be implemented as electronic hardware devices, computer software, or combinations thereof. As such, various illustrative modules/components have been described throughout this disclosure in terms of general functionality, wherein one of ordinary skill in the art will understand that the described disclosures may be implemented as hardware, software, or combinations of both.

Accordingly, it will be understood that the invention is not to be limited to the embodiments disclosed herein, but is to be understood from the following claims, which are to be interpreted as broadly as allowed under the law.

What is claimed is:

1. A system for controlling a maximum vehicle speed of a railcar mover comprising:

an engine connected to an engine control module, wherein the engine control module controls a speed of the engine and receives information from a plurality of sensors within the engine;

a display system positioned within a cab of the railcar mover;

a processor connected to the engine control module, the display system, and a throttle control module;

the throttle control module connected to a throttle control engaged by a user, wherein the throttle control module is configured to receive input from the throttle control and send instructions to the throttle control; and a non-transitory computer readable medium storing computer readable instructions that, when executed by the processor, causes the processor to at least:

acquire a predetermined value for the maximum vehicle speed from a graphical user interface configured on the display system;

calculate a target engine speed;

communicate the target engine speed to the engine control module to prevent the engine from exceeding the target engine speed;

calculate a target throttle control position;

communicate the target throttle control position to the throttle control module;

acquire an actual throttle control position;

compare the target throttle control position to the actual throttle control position; and upon determining if the actual throttle control position is less than or equal to the target throttle control position, communicate to the throttle control module to release the throttle control to the user.

2. The system of claim 1, wherein the maximum vehicle speed is controlled to within 0.1 miles per hour.

3. The system of claim 1, wherein the system recalculates the target engine speed every 50 milliseconds.

4. The system of claim 1, wherein a vehicle speed of the railcar mover does not exceed the predetermined value for the maximum vehicle speed by more than 0.1 miles per hour.

5. The system of claim 1, wherein the target throttle control position acts to give the user an intuitive sense of a required throttle position.

6. The system of claim 1, wherein the speed of the engine is controlled when the railcar mover is in either a rail mode or a road mode.

7. The system of claim 1, wherein the target engine speed is calculated using a plurality of parameters including the predetermined value for maximum vehicle speed, a transmission gear selected, a torque converter speed ratio, a vehicle rate of speed change, a vehicle operating mode, and a feature enabled state.

8. The system of claim 7, wherein the processor calculates the vehicle rate of speed change every 250 milliseconds.

9. The system of claim 7, wherein the vehicle rate of speed change is disregarded if the railcar mover is decreasing in speed.

10. A system for controlling a maximum vehicle speed of a railcar mover comprising:

an engine connected to an engine control module, wherein the engine control module controls a speed of the engine and receives information from a plurality of sensors within the engine;

a display system comprising a processor positioned within a cab of the railcar mover;

the processor connected to the engine control module, the display system, and a throttle control module;

the throttle control module connected to a throttle control engaged by a user, wherein the throttle control module is configured to receive input from the throttle control and send instructions to the throttle control; and a non-transitory computer readable medium storing computer readable instructions that, when executed by the processor, causes the processor to at least:

acquire a predetermined value for maximum vehicle speed from a graphical user interface configured on the display system;

calculate a target engine speed, wherein the target engine speed is calculated using a plurality of parameters including the predetermined value for maximum vehicle speed, a transmission gear selected, a torque converter speed ratio, a vehicle rate of speed change, a vehicle operating mode, and a feature enabled state;

communicate the target engine speed to the engine control module to prevent the engine from exceeding the target engine speed;

calculate a target throttle control position;

communicate the target throttle control position to the throttle control module;

acquire an actual throttle control position;

compare the target throttle control position to the actual throttle control position; and upon determining if the actual throttle control position is less than or equal to the target throttle control position, communicate to the throttle control module to release the throttle control to the user.

11. The system of claim 10, wherein maximum vehicle speed is controlled to within 0.1 miles per hour.

12. The system of claim 10, wherein the processor recalculates the target engine speed every 50 milliseconds.

13. The system of claim 10, wherein a vehicle speed of the railcar mover does not exceed the predetermined value for the maximum vehicle speed by more than 0.1 miles per hour.

14. The system of claim 10, wherein the target throttle control position acts to give the user an intuitive sense of a required throttle position.

15. The system of claim 10, wherein the throttle control engages in either a rail mode or a road mode of the railcar mover.

16. The system of claim 10, wherein a failure of the display system causes the system to release the throttle control to the user.

17. The system of claim 10, wherein the torque converter speed ratio is calculated using a plurality of parameters including an engine speed, a vehicle speed, and a vehicle drive ratio.

18. A system for controlling a maximum vehicle speed of a railcar mover comprising:

an engine connected to an engine control module, wherein the engine control module controls a speed of the engine and receives information from a plurality of sensors within the engine;

a display system comprising a processor positioned within a cab of the railcar mover;

the processor connected to the engine control module, the display system, and a throttle control module;

the throttle control module connected to a throttle control engaged by a user, wherein the throttle control module is configured to receive input from the throttle control and send instructions to the throttle control; and a non-transitory computer readable medium storing computer readable instructions that, when executed by the processor, causes the processor to at least:

acquire a predetermined value for maximum vehicle speed;

calculate a target engine speed, wherein the target engine speed is calculated using a plurality of parameters including the predetermined value for maximum vehicle speed, a transmission gear selected, a torque converter speed ratio, a vehicle rate of speed change, a vehicle operating mode, and a feature enabled state;

communicate the target engine speed to the engine control module to prevent the engine from exceeding the target engine speed;

calculate a target throttle control position, wherein the target throttle control position is calculated using at least the target engine speed;

communicate the target throttle control position to the throttle control module;

acquire an actual throttle control position;

compare the target throttle control position to the actual throttle control position; and upon determining if the actual throttle control position is less than or equal to the target throttle control position, communicate to the throttle control module to release the throttle control to the user.

19. The system of claim 18, wherein the throttle control engages in either a rail mode or a road mode of the railcar mover.

20. The system of claim 18, wherein the target throttle control position acts to give the user an intuitive sense of a required throttle position.

* * * * *